US005545864A

United States Patent [19]

Bauer et al.

[11] Patent Number: 5,545,864

[45] Date of Patent: Aug. 13, 1996

[54] PUSH SWITCH

[75] Inventors: Karl-Heinz Bauer; Gerold Eckert; Edgar Maisch, all of Bad Neustadt a. d. Saale; Anton Rüttiger, Wildflecken, all of Germany

[73] Assignee: Preh-Werke GmbH & Co. KG, Bad Neustadt a.d. Saale, Germany

[21] Appl. No.: 283,899

[22] Filed: Aug. 3, 1994

[30] Foreign Application Priority Data

Sep. 9, 1993 [DE] Germany ..... 43 30 576.8

[51] Int. Cl.[6] ..... H01H 1/26

[52] U.S. Cl. ..... 200/283; 200/246; 200/535; 200/546

[58] Field of Search ..... 200/335, 275, 200/282, 283, 246, 244, 245, 247, 250, 468, 341, 532, 533, 534, 535, 546, 260, 520

[56] References Cited

U.S. PATENT DOCUMENTS

| | | | |
|---|---|---|---|
| 4,035,596 | 7/1977 | Marquardt et al. | 200/535 |
| 4,277,663 | 7/1981 | Soes | 200/283 |
| 4,789,764 | 12/1988 | Doros | 700/535 |

FOREIGN PATENT DOCUMENTS

| | | |
|---|---|---|
| 0074004A2 | 3/1983 | European Pat. Off. . |
| 0123818A1 | 11/1984 | European Pat. Off. . |
| 0515943A2 | 12/1992 | European Pat. Off. . |
| 2450742 | 4/1976 | Germany . |
| 2556461 | 6/1977 | Germany . |
| 2556461 | 6/1977 | Germany . |
| 2729216 | 12/1978 | Germany . |
| 8114214.5 | 5/1981 | Germany . |
| 3520848A1 | 10/1985 | Germany . |
| 3622962A1 | 1/1988 | Germany . |
| 9314076.2 | 11/1993 | Germany . |
| 9314076 | 1/1994 | Germany . |
| 671648 | 9/1989 | Switzerland . |
| 671648A5 | 9/1989 | Switzerland . |

*Primary Examiner*—David J. Walczak
*Attorney, Agent, or Firm*—Griffin, Butler, Whisenhunt & Kurtossy

[57] ABSTRACT

A push button switch (3) encounters, during a stroke of a push rod (6) thereof, a pressure point (D), a switching (contact-making) movement, and a return tension. A one-piece spring element (16) is provided for achieving this with an uncomplicated structure, with a short stroke, and with a reliable contact once the pressure point has been overcome. The one-piece spring element has, between a contact arm (26) and a return arm (21), hairpin-shaped bent guide legs (17, 18). A sloping step (24) formed on at least one of the guide legs creates the pressure point.

14 Claims, 10 Drawing Sheets

PUSH SWITCH

BACKGROUND OF THE INVENTION

This invention concerns a push switch with a push rod which encounters during its movement stroke, a pressure point (or resistance point), a contact-making point, and return pressure caused by spring action.

Such push switches are disclosed in German Gebrauchsmuster 81 14 214.5, German Offenlegungsschrift 35 20 848 A1, European Patent 0 074 004 A2, European Patent 0 123 818 A1, and European Patent 0 515 943 A2. In these publications spring elements are respectively provided for each of the functions: pressure point creation, contact making, and return force. Fabrication and mounting expenses are correspondingly great. Further difficulties result where a switching stroke of a push rod is small if it must be assured that, during such a stroke, the pressure point is encountered before the switching point.

Such a push switch is also disclosed in German Patent DE 36 22 962 A1. With this switch, a clearly perceptible movement is supposedly achieved for a small stroke, for example a stroke in a range of 1 mm to 3 mm, with the pressure point lying before the switching point. Such switches are required, for example, for motor vehicle electrical circuits.

In the push switch of German Patent DE 36 22 962 A1 an end winding of a spiral shaped return spring, with inwardly directed deformed portions which cooperate with a sloped engaging edge of a push rod, is provided for creating a pressure point. A contact-making, or closing, is brought about by a contact spring assembly which is independent thereof. The structural arrangement of the contact spring assembly and the push rod is tolerance sensitive in view of the short stroke and a required switch path. The spiral shaped return spring, with its inwardly directed deformed portions which provide radial spring action, is difficult to dimension. Further, friction is caused between the above mentioned portions and the push rod after the pressure point has been overcome.

Additionally, a contact pressure cannot be reinforced by the push rod.

Thus, it is an object of this invention to provide a push switch of the type mentioned above which, with an uncomplicated structure and a short stroke, provides a reliable contact movement once the pressure point has been overcome.

SUMMARY OF THE INVENTION

According to principles of this invention, a one-piece spring element is provided which forms, on one side, a spring-action contact arm and, on another side, a spring return arm which engages a push rod, wherein the spring element has spring guide legs formed thereon in the shape of a bent hairpin positioned between the contact arm and the return arm on which the push rod slidably rides, with at least the guide leg adjacent the contact arm having a sloping step formed thereon against which the push rod engages during a stroke thereof for causing a pivoting of this guide leg and thereby the contact arm.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
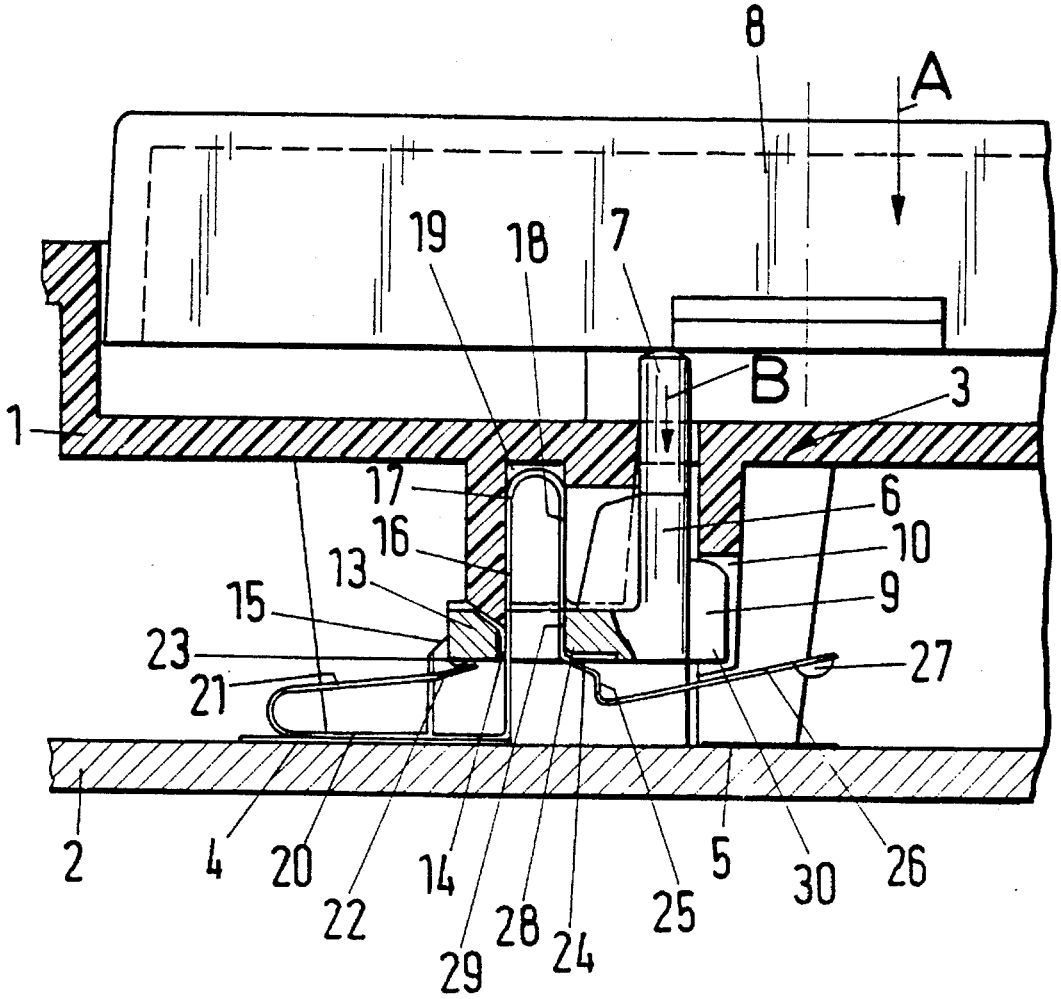
FIG. 1 is a side, partially-cross-sectional, view, of a first embodiment push switch of this invention, enlarged approximately by a factor of 10.

A housing 1 is arranged over a plate 2 on which two conductive layers, or leads, 4 and 5 are found to be coupled together (or closed) by means of a push switch 3. The push switch 3 has a push rod 6. A finger 7 of the push rod 6 rises above the housing i and is engagable by means of an activation member 8. A rib 9 is formed on the push rod 6 to engage in a cavity 10 of the housing 1. Instead of this, or in addition thereto, the push rod 6 can also be guided laterally, or to the side, at positions 11 and 12 of the housing 1 (see FIG. 3). In any case, the push rod 6 is guided to move lengthwise with very little friction. An arm 13 is formed on the push rod 6 which is provided with a through opening 14. At the arm 13 there is a beveled surface 15 formed on the housing 1 on which the arm 13 slides as is described in more detail below.

The push switch 3 has a one-piece spring element 16 which is manufactured of a stamped, or forged, bent part; for example of a partially gold plated V2A-steel. The spring element comprises two bent guide legs 17 and 18, arranged together in the shape of a hairpin which extends through the through opening 14 of the arm 13 and into a recess 19 of the housing 1. The guide leg 17 leads into a coupling leg 20 at a transition which is seated on the conducting lead 4 to make electrical contact therewith. To improve this contact, corrugations can be formed on the coupling leg 20. A spring return arm 21 is formed as one piece with the coupling leg 20 and bent in a hairpin shape wherein the return arm 21 has a free end 22 lying against a button, or knob, 23 of the arm 13 of the push rod 6.

A slanted, or sloped step 24 is formed on the guide leg 18 at a transition position (see FIG. 1) beneath the arm 13. A spring contact arm 26 of the spring element 16 is formed at a lower end of the guide leg 18 whose contact boss, or terminal, 27 is above the conducting lead 5 in an initial position. The contact arm 26 can also form two or more contact fingers.

Operation of the described push switch is generally as follows:

In an initial position (FIG. 1) the push rod 6 is held upwardly by means of the return arm 21 which exerts a predetermined biassing tension. The push rod 6 is thereby seated against a stop on the housing 1. If the activation member 8 is pressed in a direction of an arrow A, an edge 28 forming the through opening 14 presses against the sloped step 24 so that the guide leg 18 pivots toward the guide leg 17, whereby a predetermined tension is developed between the guide legs 17 and 18. Thus a perceivable force is necessary to accomplish this. This force progression, or rise, is represented in the diagram of FIG. 10 at an area "a".

Figure 2:
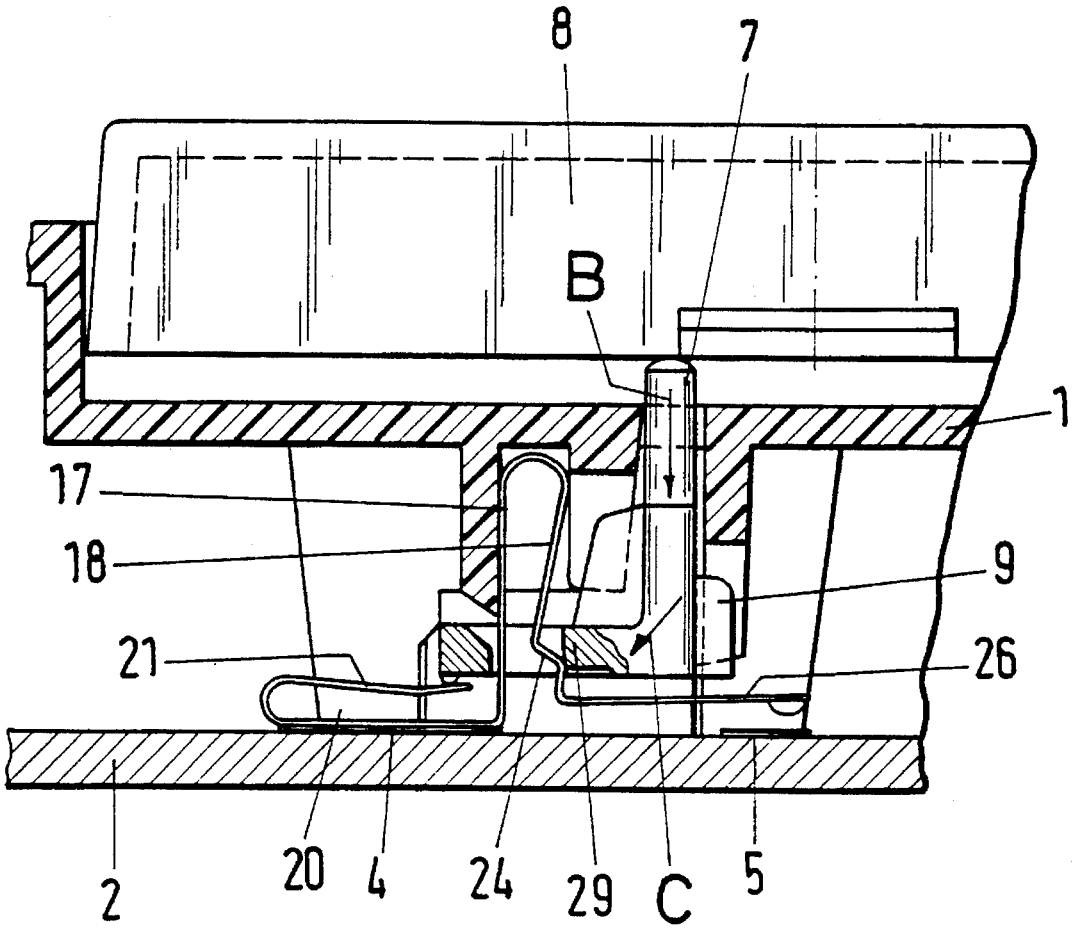
FIG. 2 is a view similar to that of FIG. 1 but with a push rod of the push switch having been moved to overcome a pressure point.
Figure 10:
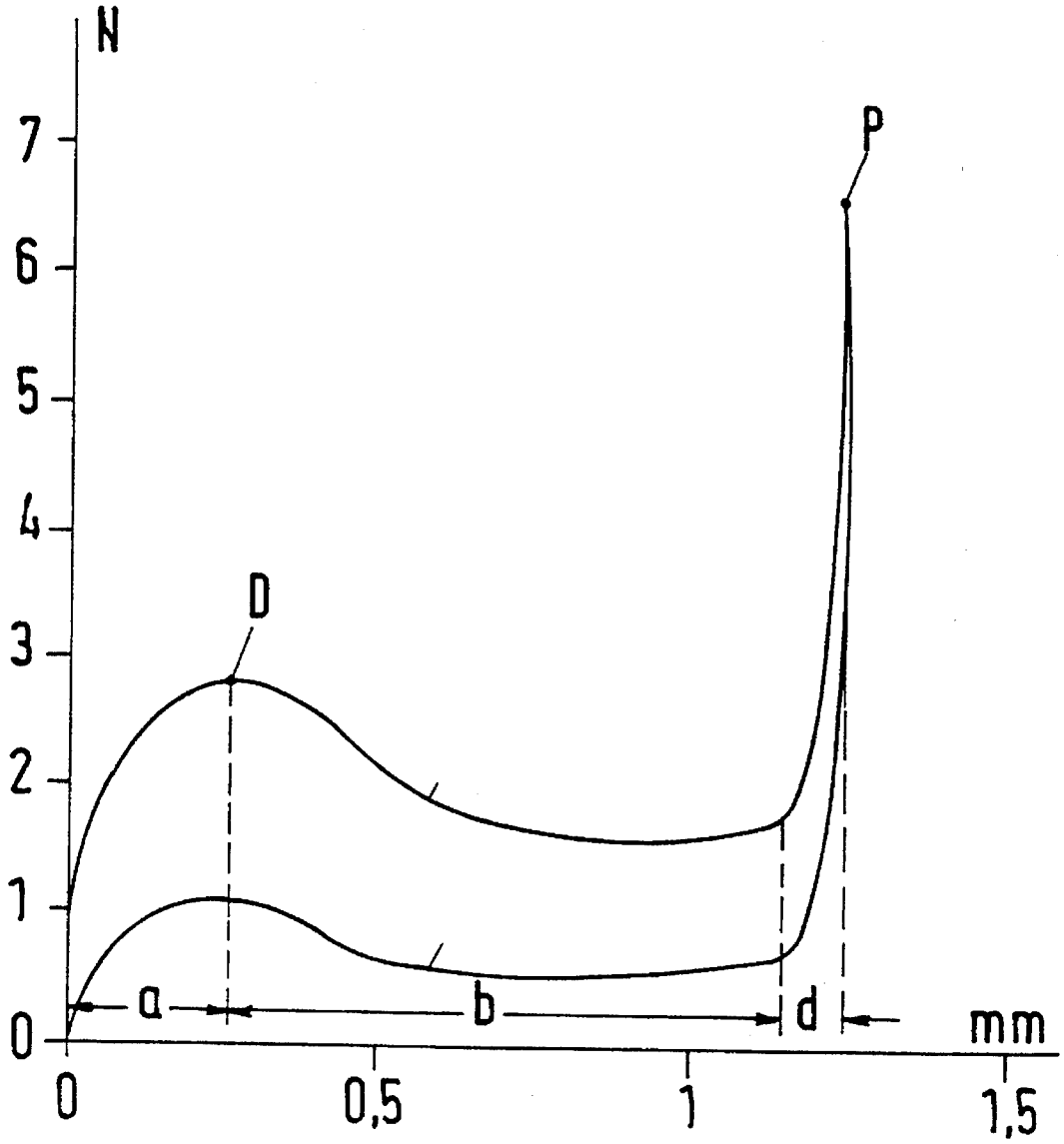
FIG. 10 is a diagram of force versus path of a push switch of this invention.

If the edge 28 arrives at the end of the slope step 24 (see FIG. 2), a pressure point (or resistance) D is reached (see FIG. 10). Up until this point, the push rod has pushed in the direction of the arrow B. Upon reaching the pressure point D the arm 13 impinges, upon further movement in direction of the arrow A, against the beveled surface 15 so that it generally moves in a direction of an arrow C in a tipping, or tilting, movement. An edge 29 defining the through opening 14, above the corner, or edge, 28, now presses a lower end 25 of the guide leg 18 further toward the guide leg 17. Because of this, the contact arm 26 claps against the conducting lead, or layer, 5. As this is accomplished, a decreasing actuation pressure must be applied relative to the pressure point D. This pressure area is shown in the diagram of FIG. 10 at a portion of the stroke "b".

Figure 4:
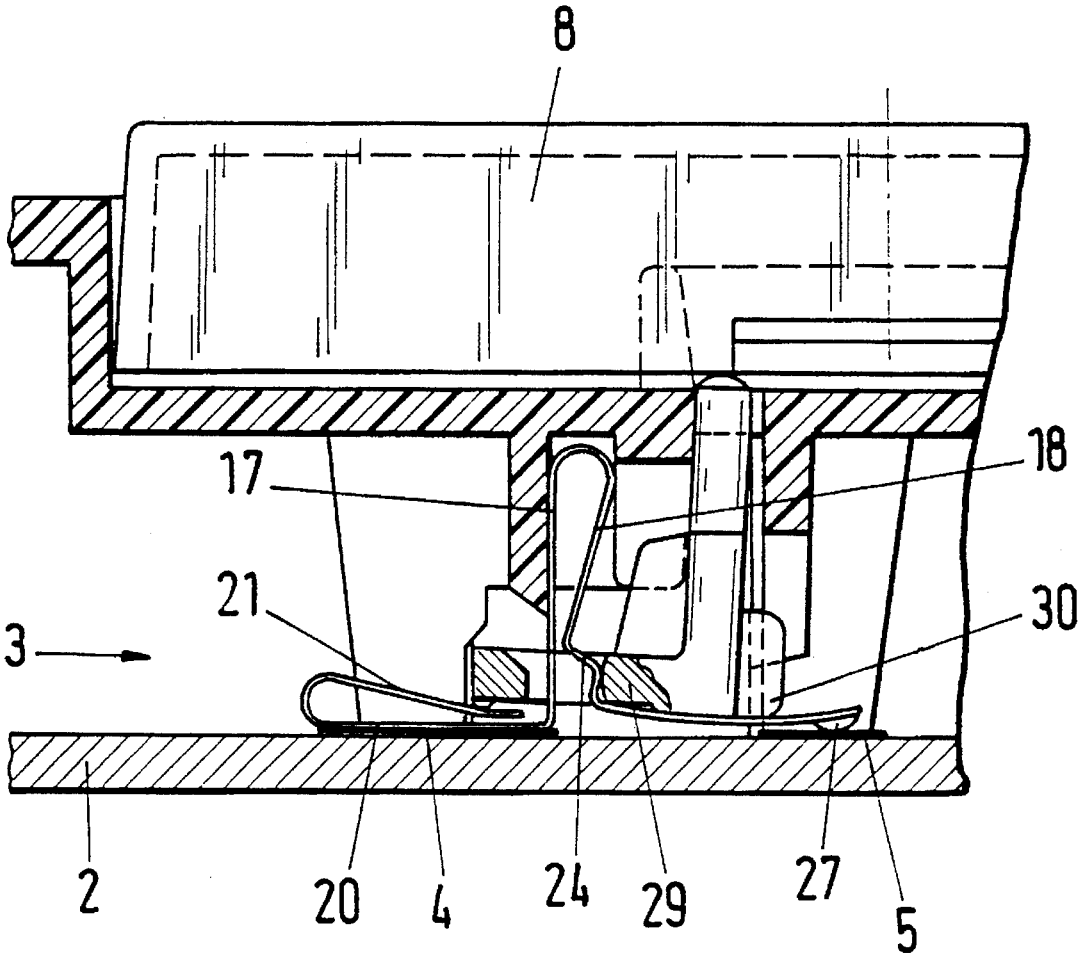
FIG. 4 is a view similar to FIGS. 1 and 2 but after the push rod has been moved to make, or close, contact.

At an end of the actuation, or movement, stroke, a nose 30 of the push rod 16 contacts the contact arm 26 so that it is thereby deformed, whereby the contact pressure is increased (see FIG. 4). This pressure area is shown in the diagram of FIG. 10 at d. The compressing pressure P of the contact arm 26 against the conducting lead 5 is greater than the pressure at the pressure point D.

During this described stroke, the return arm 21 has become tensioned (compare FIGS. 1 and 4).

Once the activation member 8 has been released, the contact arm 26 and the return arm 21 can relax, whereby the push rod 6 and the activation member 8 are returned to their initial positions (FIG. 1). This return movement is shown in the diagram of FIG. 10 in the lower curve.

The stroke of the push rod 6 is in a dimension range between 1 mm and 2 mm, and that of the one shown in the diagram of FIG. 10 is approximately 1,2 mm. The pressure point D is reached at 0,25 mm.

Figure 3:
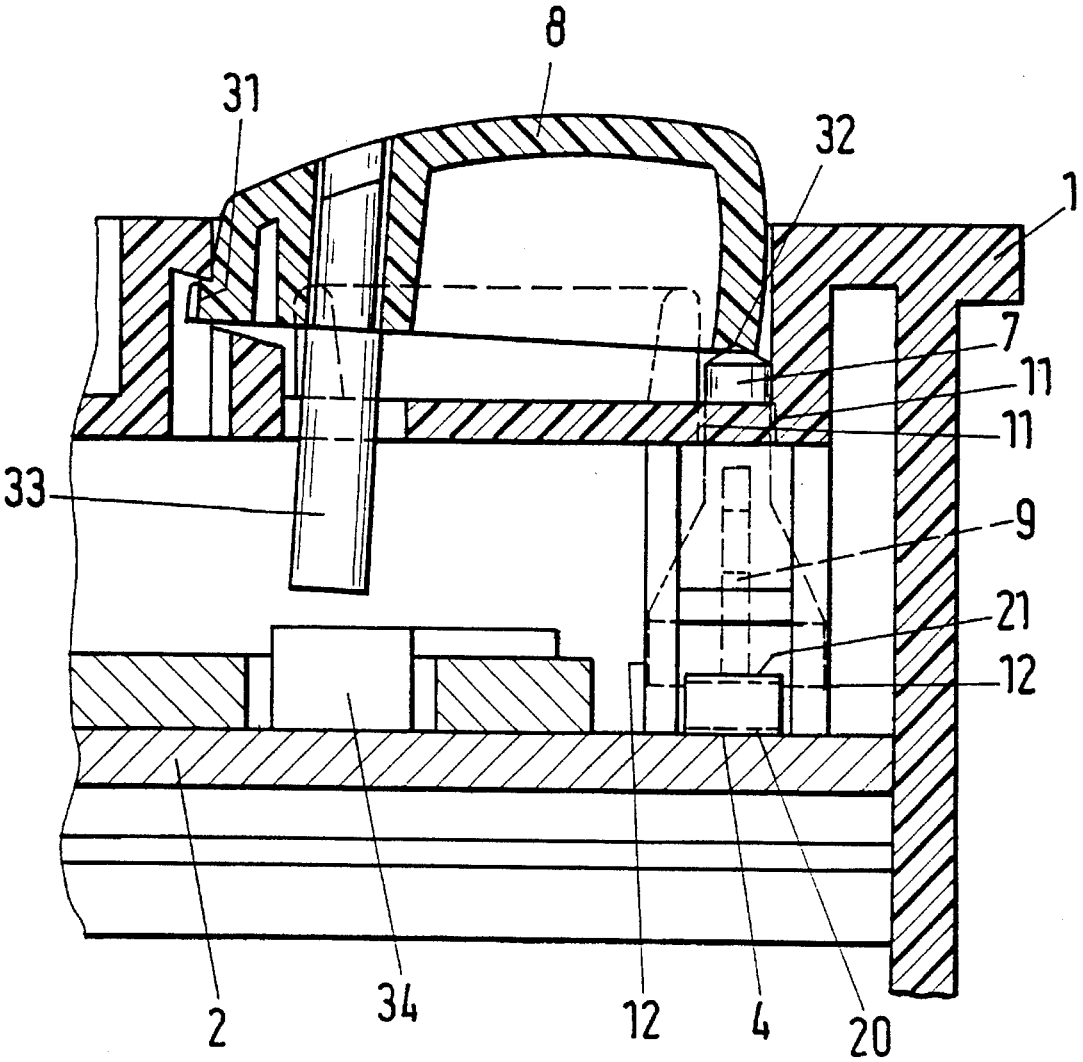
FIG. 3 is a partially cross sectional side view taken 90° to the view of FIG. 2.
Figure 5:
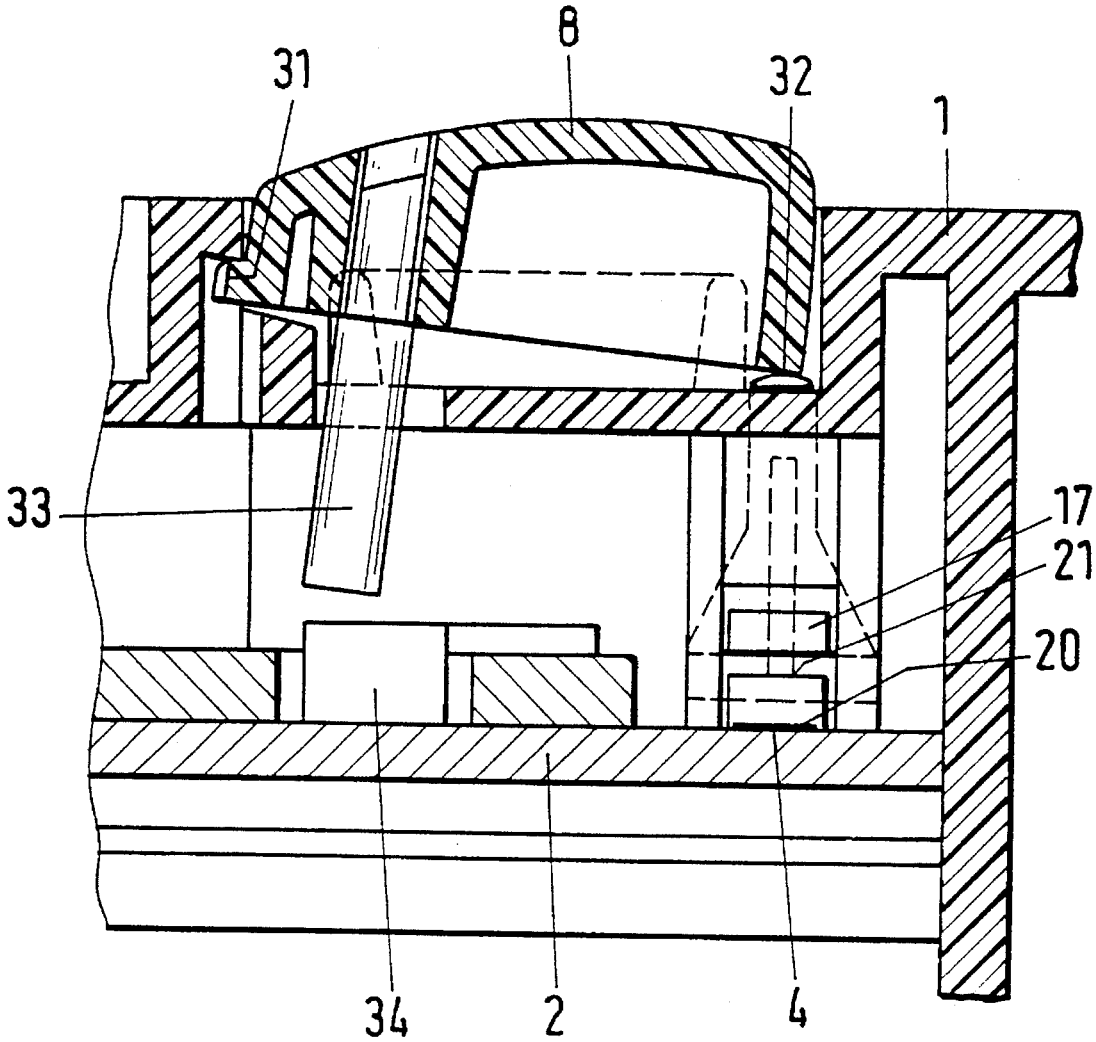
FIG. 5 is a partially cross sectional side view taken 90° to the view of FIG. 4.

The activation member 8 is in this embodiment mounted to be tilted at the housing 1 (compare FIGS. 3 and 5). It can be thereby tilted, or pivoted, about a protrusion 31 which is positioned opposite to an activation surface 32 for the finger 7 of the switch push rod 6. A light conductor 33 is attached to the activation member 8 to be positioned opposite an LED-light source 34 on the plate 2. The push rod 6 can, however, also be attached to other activation members.

As is shown in the described embodiment, it is not necessary for a mechanical and electrical coupling between the push switch 3 and the plate 2 that the plate be provided with through openings for the push switch or that a soldered junction must be provided. A contact closing for the conductive layers, or leads, 4 and 5 results by an uncomplicated pressing of the push switch 3, particularly of the coupling leg 20 and the contact arm 26, upon switching.

Figure 6:
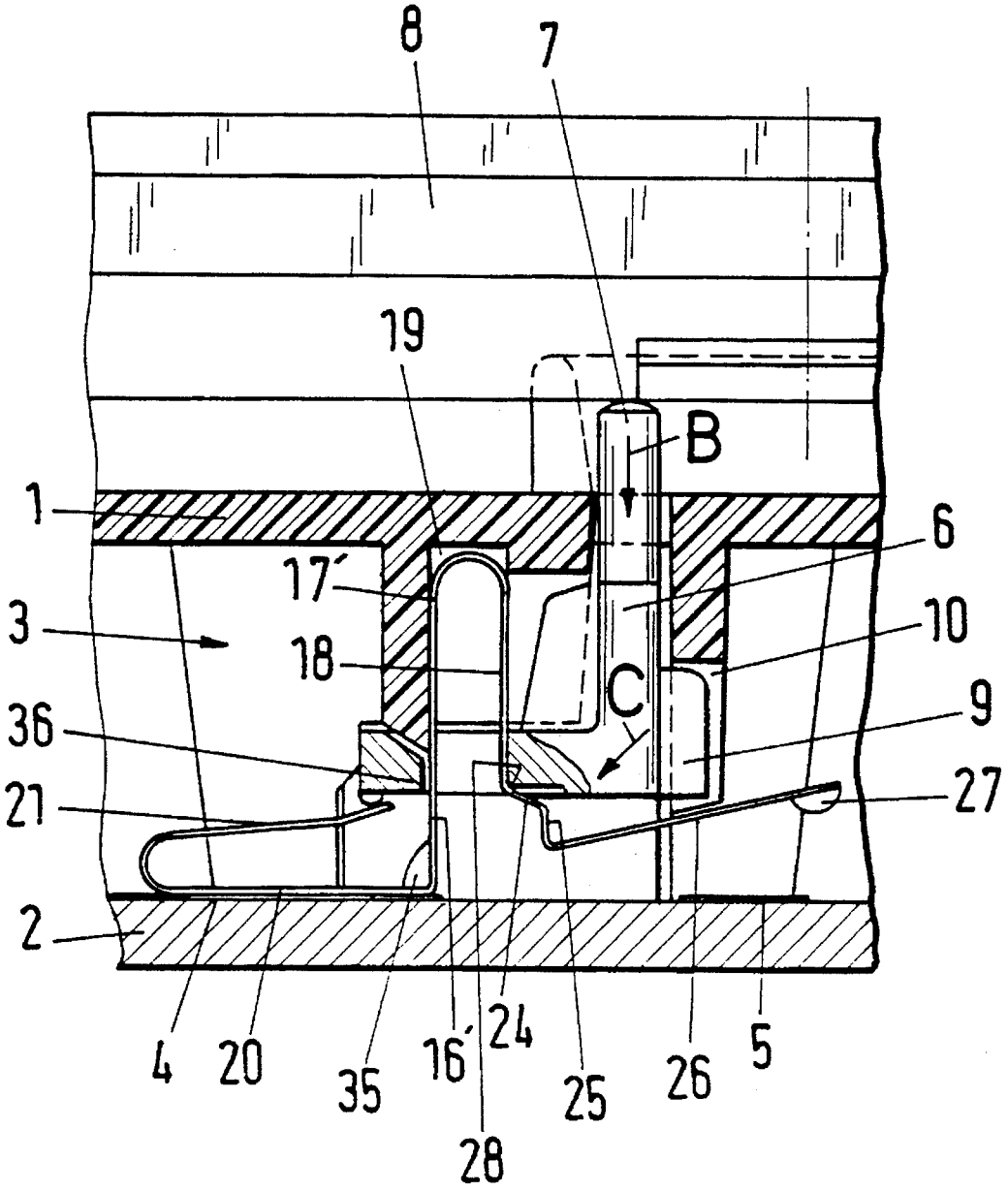
FIG. 6 is a side, cross sectional, view of a second embodiment push switch of this invention along with surrounding structures.

In the embodiment of FIG. 6, a tilting movement of the push rod 6 in a direction of an arrow C, after the pressure point D is reached, is not achieved by the beveled surface 15 and a corresponding shape of the arm 13. The tilting movement is beneficial because it leads to reduced friction and makes possible an increased contact pressure because of a further spacing of the position of the through opening 14 from a force applied to the finger 7.

In the embodiment of FIG. 6, a bulge 35 formed at a lower end of a guide leg 17' creates this tilting movement. After the pressure point D has been reached, a corner 36, opposite the corner, or edge, 28 of the through opening 14, makes contact with the bulge 35. In this case, the one-piece spring element 16' also takes on the function of bringing about the tilting of the push rod 6.

Finally, it is also possible to give the lengthwise guiding function of the push rod 6 to the guide legs 17 and 18 so that the rib 9 can be eliminated. To accomplish this, the through opening 14 must have a width which corresponds to the width of the guide legs 17 and 18.

Figure 7:
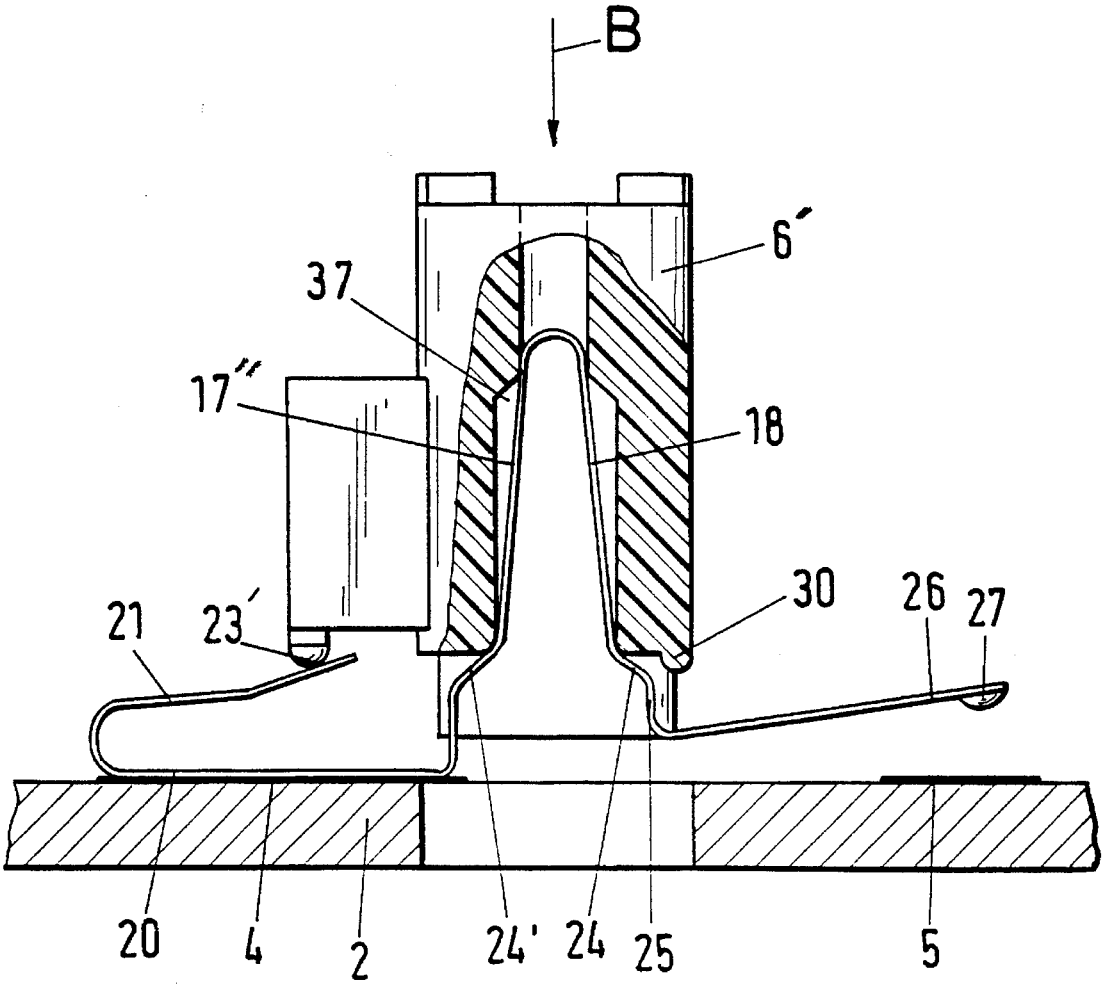
FIG. 7 is a side, partially cutaway and partially cross sectional, view of a third embodiment push switch of this invention with surrounding structures.
Figure 8:
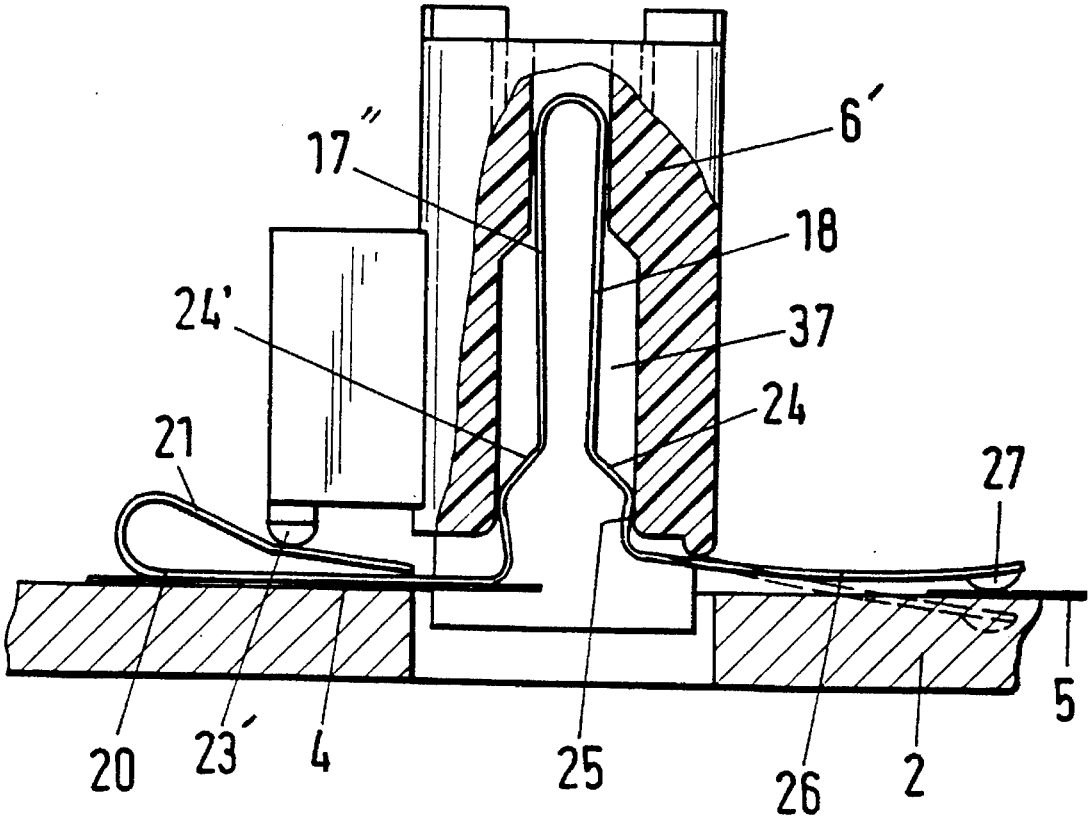
FIG. 8 is a view similar to FIG. 7 but with a push rod thereof being moved to a contact-making position.

In the embodiment of FIGS. 7 and 8, sloping steps 24, 24' are respectively formed on each of the guide legs 17", 18. The guide legs 17", 18 are guided in a passage 37 of the push rod 6' whereby the passage 37 extends in the movement direction B of the push rod 6'. Thus, it does not lie adjacent to a direction in which a pressure force is applied, as does the through opening 14, but rather concentric thereto. The described tilting movement does not take place in this case.

If the push rod 6' has force applied thereto in the movement direction B, then both sloped steps 24, 24' create the pressure point. The push rod 6' slides thereby over the steps 24, 24' (see FIG. 8). Thus, the coupling leg 20 is slid across the conductive layer, or lead, 4. The contact arm 26 is also here biased by a nose so that it presses against the conducting lead 5 with an increased contact pressure. The return arm 21 is biased against a button 23'.

Figure 9:
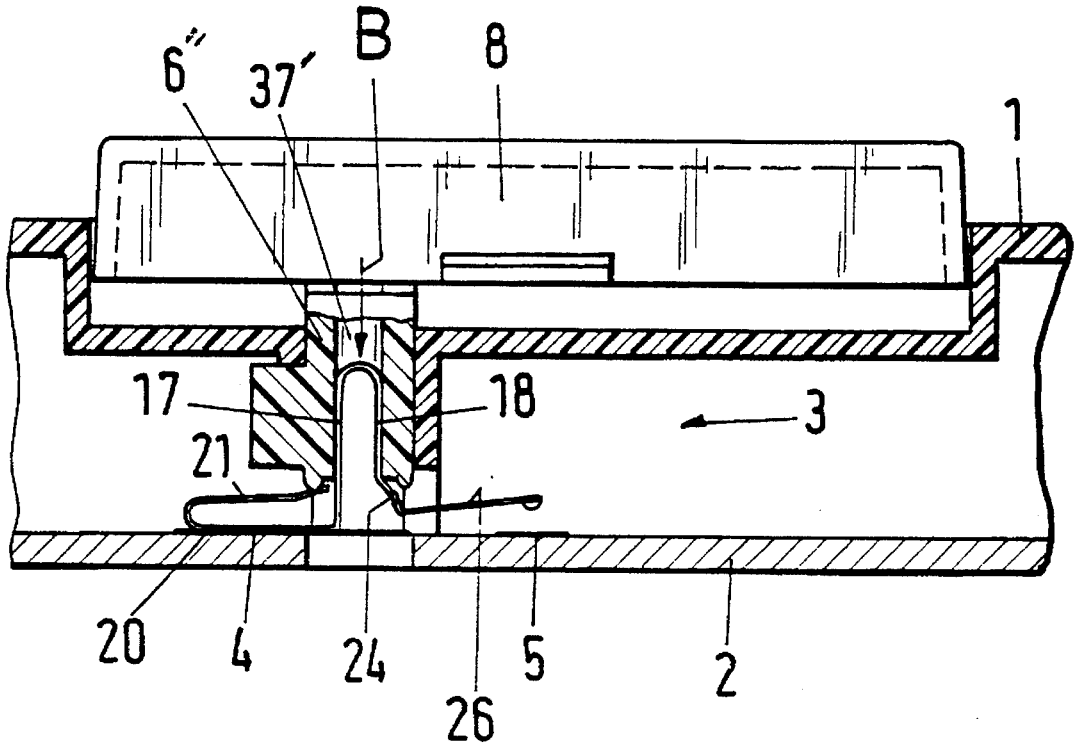
FIG. 9 is a side cross sectional view of a push switch of a fourth embodiment push switch of this invention and surrounding structure.

The embodiment of FIG. 9 is a combination of the embodiments of FIGS. 1 and 7. The guide legs 17, 18 are seated in a central passage 37' extending in the movement direction B. Only the guide leg 18 has the sloping step 24. The coupling leg 20 is not slid on the conductive lead 4 upon movement of a push rod 6". The above described tilting movement of the push rod 6" does not take place in this case. The contact arm 26 is also in this case biased by means of a nose pressing against the contact arm, or surface, 26. In the embodiments of FIGS. 7 through 9 one must expect a higher friction from the guide legs 17 (17'), 18 of the one-piece spring element 16 (16') than in the embodiment of FIGS. 1 through 6 because the guide legs 17, 18 extend into the push rod 6.

Generally, in this invention, the one-piece spring element takes over the functions of creating a pressure point, making a contact (as well as opening a contact) and returning a push rod. The construction costs and mounting costs are relatively small. The spring element can be manufactured as a stamped bent piece in an uncomplicated manner. Further, by using the spring element, it is possible to make the push switch to have a small profile.

Upon movement of the push rod the push rod first impinges on the sloped step whereby a distinctly perceptible resistance is brought about. The guide legs are thereby tensioned. When the push rod then leaves the step, this pressure point is overcome and a contact closing is brought about by the contact arm. During this stroke, the push rod tensions the return arm, which returns the push rod back to its initial position.

While the invention has been particularly shown and described with reference to a preferred embodiment, it will be understood by those of ordinary skill in the art that various changes in form and detail may be made therein without departing from the spirit and scope of the invention.

For example, if the switch has a particular arrangement of switch contacts which are to be closed in a rest position, the contacts would be opened as soon as the guide legs are tensioned by movement of the push rod.

The embodiments of the invention in which an exclusive property or privilege are claimed are defined as follows:

1. A push switch having a push rod whose movement stroke passes through a pressure point, a switching movement, and a return tension under effects of a one-piece spring element, comprising:

the push rod;

the one-piece spring element, forming on one side a spring-actuated contact arm for engaging the push rod and making contact with a conductor and on another side a spring return arm for engaging the push rod and returning the push rod to an initial position, said spring element having first and second spring guide legs formed thereon in the shape of a bent hairpin positioned between the contact arm and the return arm, the push rod being slidably mounted on said first and second spring guide legs, wherein at least the first spring guide leg adjacent the contact arm has a sloping step formed thereon against which the push rod engages during a stroke thereof causing a pivoting of the first spring guide leg and thereby the contact arm which is connected to the first and second guide leg.

2. A push switch as in claim 1 wherein the spring element is a metallic stamped-out bent part.

3. A push switch as in claim 1 wherein the spring element is a good electrical conductor.

4. A push switch as in claim 3 wherein the contact arm is arranged over a first conductive lead member of a plate and wherein a coupling leg for coupling the return arm with the second spring guide leg of the spring element lies on a second conductive lead member of the push switch.

5. A push switch as in claim 4 wherein the coupling leg and the return arm together form a hairpin shape.

6. A push switch as in claim 1 wherein is further included a first guide means for guiding the push rod in a linear manipulation direction.

7. A push switch as in claim 1 wherein is further included a second guide means for guiding said push rod to be tilted at an angle to a linear manipulation direction.

8. A push switch as in claim 7 wherein the push rod has an arm with a through opening through which the first and second spring guide legs extend, whereby the opening and the first and second spring guide legs are spaced from a direction of manipulation force applied to the push rod to cause a stroke thereof.

9. A push switch as in claim 7 wherein said second guide means causes a tilting of the push rod as it is leaving the step while a linear force is being applied thereto for moving it in a stroke to make contact, said second guide means comprising a beveled surface for contacting said push rod.

10. A push switch as in claim 9 wherein the tilting of the push rod, as it is leaving the step while being moved in a linear stroke direction, presses the first spring guide leg toward the second spring guide leg so that the contact arm tilts toward a first conductive lead member.

11. A push switch as in claim 1 wherein a tilting of the push rod, as it is leaving the step, is caused by a bulge on one of the first and second spring guide leg.

12. A push switch as in claim 1 wherein the push rod has a central passage extending in a direction of manipulation force applied to the push rod to cause a stroke thereof in which the first and second spring guide legs engage.

13. A push switch as in claim 12 wherein both said first and second spring guide legs of the push rod have sloping steps thereon and wherein a coupling leg for coupling the return arm to the second spring guide leg is slidable along a second conductive lead of the push switch.

14. A push switch as in claim 1 wherein the push rod has a protruding nose which presses against the contact arm when the contact arm is lying on a conductive lead member.

* * * * *